US007772958B2

(12) United States Patent
Schlötzer

(10) Patent No.: US 7,772,958 B2
(45) Date of Patent: Aug. 10, 2010

(54) LOAD SHEDDER

(75) Inventor: Eugen Schlötzer, Rednitzhembach (DE)

(73) Assignee: Lisa Dräxlmaier GmbH, Vilsbiburg (DE)

( * ) Notice: Subject to any disclaimer, the term of this patent is extended or adjusted under 35 U.S.C. 154(b) by 413 days.

(21) Appl. No.: 11/662,444

(22) PCT Filed: Sep. 8, 2005

(86) PCT No.: PCT/EP2005/009679

§ 371 (c)(1),
(2), (4) Date: Dec. 6, 2007

(87) PCT Pub. No.: WO2006/027251

PCT Pub. Date: Mar. 16, 2006

(65) Prior Publication Data

US 2008/0191830 A1 Aug. 14, 2008

(30) Foreign Application Priority Data

Sep. 9, 2004 (DE) ..... 10 2004 044 110

(51) Int. Cl.
*H01H 37/36* (2006.01)

(52) U.S. Cl. ..... 337/157; 337/114; 337/30; 337/401; 337/405; 361/115; 200/61.08

(58) Field of Classification Search ..... 337/114, 337/157, 30, 401, 405; 361/115; 200/61.08
See application file for complete search history.

(56) References Cited

U.S. PATENT DOCUMENTS 2,096,619 A 10/1937 Prince (Continued)

FOREIGN PATENT DOCUMENTS

BE 467 194 A 9/1946

(Continued)

OTHER PUBLICATIONS

International Search Report EP 05 00 9679, dated Dec. 28, 2005.

*Primary Examiner*—Anatoly Vortman
(74) *Attorney, Agent, or Firm*—Wolf, Greenfield & Sacks, P.C.

(57) ABSTRACT

A circuit breaker with a first contact sleeve (3, 14), a second contact sleeve (4, 16), an insulating sleeve (5, 18) disposed between the first contact sleeve (3, 14) and the second contact sleeve (4, 16) has a switching piston (6, 20) with at least one contact section (8) and an isolating section (7, 19), which is disposed at the side of the contact section (8), whereby the switching piston (6, 20) is movable between a closed position in which the contact section (8) of switching piston (6, 20) connects the first contact sleeve (3, 14) with the second contact sleeve (4, 16) so as to be electrically conductive, and an open position in which the contact section (8) of the switching piston (6, 20) does not connect the first contact sleeve (3, 14) with the second contact sleeve (4, 16), in which the first contact sleeve (3, 14), second contact sleeve (4, 16) and insulating sleeve (5, 18) is movable. The isolating section (7, 19) is elastically deformable and in the insulating sleeve (5, 18) exerts a surface pressure force on the surface thereof due to elastic deformation. The circuit breaker according to the invention is reclosable.

10 Claims, 2 Drawing Sheets

U.S. PATENT DOCUMENTS 2,721,240 A * 10/1955 Filbert, Jr. ..... 200/83 R
2,892,062 A * 6/1959 Heyser et al. ..... 337/290
3,118,986 A * 1/1964 Lewis et al. ..... 200/82 R
3,129,307 A * 4/1964 De Vargas ..... 218/1
3,277,255 A * 10/1966 Mattsson et al. ..... 200/61.08
3,356,808 A * 12/1967 Dakin et al. ..... 337/117
3,719,912 A * 3/1973 Harner et al. ..... 337/280
3,873,786 A * 3/1975 Lagofun ..... 200/61.08
3,958,206 A * 5/1976 Klint ..... 337/406
3,965,452 A * 6/1976 Chabala et al. ..... 337/280
4,183,005 A * 1/1980 Meister et al. ..... 337/275
4,220,942 A * 9/1980 Meister et al. ..... 337/277
4,271,339 A * 6/1981 Meister et al. ..... 218/150
4,342,978 A * 8/1982 Meister ..... 337/6
4,490,707 A * 12/1984 O'Leary ..... 337/6
RE32,321 E * 12/1986 Tobin ..... 200/82 B
4,692,577 A * 9/1987 Swanson ..... 218/117
5,070,787 A * 12/1991 Weldon et al. ..... 102/216
5,416,286 A * 5/1995 Dixon, Jr. ..... 200/16 E
6,078,108 A 6/2000 Froschl et al.
6,194,988 B1 * 2/2001 Yamaguchi et al. ..... 337/157
6,232,568 B1 * 5/2001 Hasegawa et al. ..... 200/61.08
6,295,930 B1 * 10/2001 Kume et al. ..... 102/202.5
6,411,190 B1 * 6/2002 Yamaguchi et al. ..... 337/401
6,448,884 B1 * 9/2002 Yamaguchi et al. ..... 337/401
6,954,132 B2 * 10/2005 Lell et al. ..... 337/30
7,239,225 B2 * 7/2007 Tirmizi ..... 337/30
7,518,483 B2 * 4/2009 Brede et al. ..... 337/409

FOREIGN PATENT DOCUMENTS

DE 196 20 204 A1 11/1997

* cited by examiner

LOAD SHEDDER

RELATED APPLICATIONS

This application is a National Stage filing under 35 U.S.C. §371 of international application PCT/EP2005/009679, filed Sep. 8, 2005.

BACKGROUND

It is known amongst other things to use pyrotechnic methods, which blast the conductor or which cut the conductor by way of a mechanical system, for the rapid isolation of electric circuits.

On one hand these known circuit breakers have the disadvantage of being relatively expensive and on the other it is no longer possible to close the electric circuit again after isolation. The isolating element has to be bridged or even replaced if a false trip occurs or when the cause of the trip has been rectified.

A device for interrupting the flow of current in a cable is known from WO 97 37 873 A1. Disposed in a housing with two electrical connection terminals that are isolated from each other are two sleeves which are electrically insulated from each other, connected in each case to at least one connection terminal and are linked by a plastic sheath. A piston-like actuating element is arranged in both sleeves which makes contact with the sleeves by means of contact springs as well as joining the two sleeves electrically in a contact position and which fails to make a connection in an isolating position. Ignition of a pyrotechnic charge creates explosion gases which push the actuating element into the isolating position.

The disadvantage of the prior art is that an arc occurring at the precise moment of isolation is not safely and reliably suppressed with the result that there may be burn-out and damage to the surfaces of the actuating element and the sleeves which make reclosure or repeated actuation difficult or prevent it.

A switch is known from DE 1 260 590 which opens a charge by means of an explosion. A cylindrical housing holds a piston-like movable contact body in which an explosive charge is disposed. This charge may be ignited by separate electrical wires. The contact body is guided into a hole of the housing by a rod connected to it and on actuation of the charge is ejected out of the cylindrical part of the housing. The contact body can be pushed back by means of the rod.

The disadvantage of this prior art is that on actuation the guide may lead to wear and deflections due to the rod alone and as a result this may impede reclosure.

Therefore, it is the object of the invention to create an electric circuit breaker which is inexpensive, can easily be reclosed after actuation and which suppresses an arc that causes wear.

SUMMARY

A circuit breaker according to one embodiment is simply constructed and can be used easily for a plurality of cases. Above all, an are occurring at the moment of isolation is safely and reliably suppressed as the isolating section lying adjacent to the contact section is pushed into the insulating sleeve on isolation. The elastic deformation of the isolating section and the surface pressure occurring between the surface of the insulating sleeve and the isolating section prevent any air gap. An arc is quickly isolated and prevented by the isolating section which is made of insulating material. Burn-out and damage to the surfaces of the contact section and the first and second contact sleeve are eliminated. In addition, an arc is suppressed since the circuit breaker isolates very quickly. The switching piston is already being accelerated at the moment of isolation and is already moving, unlike known constructions where there is actuation of contacts that are originally static.

In an advantageous embodiment, the contact section has contact areas that establish an electrically conductive contact to the first or second contact sleeve.

As a result, electrical contact is assured due to the higher surface pressure in the small contact areas even when the switching piston is moving during switching off. Wear due to arcs is prevented.

The contact section may comprise of a metal sleeve in which a split piston of elastic material is inserted with split rings and the contact areas may be ring-shaped spread-out areas of the metal sleeve formed by the split rings. In this case the thickness of the material of the metal sleeve is chosen so that it can be deformed by the force of the split piston's elastic deformation. The split piston may be executed in one piece with the isolating section.

The result of this is that contact areas can be formed in a simple manner.

Advantageously, the contact section may comprise a metal sleeve which has elastic sections due to slots, said sections forming the contact areas. In particular, an elastic section of the metal sleeve may also have a convex bulge which increases the contact pressure.

A contact area on the outermost edge of the contact section and disposed immediately abutting the isolating section is advantageous.

In a favorable embodiment, the insulating sleeve is executed in one piece with a component of the circuit breaker's housing.

This makes it possible to adapt the circuit breaker to different voltages simply by adapting one component. The insulating path formed by the insulating sleeve may be executed in different lengths with the result that the overall length of the circuit breaker changes slightly.

In a favorable embodiment, the first contact sleeve is sealed by a flange in which is inserted at least one propellant charge generating gas.

The isolating section of the switching piston may seal against gases in relation to the first contact sleeve.

The isolating section and thus the switching piston are displaced by ignition of the propellant charge. This enables very rapid switching.

The propellant charge may be an explosive propellant charge or a cartridge of a gas under very high pressure.

In a favorable embodiment, a plurality of propellant charges inserted in recesses of the flange is present and the recesses of the flange are sealed with plugs.

This enables repeated actuation of the circuit breaker after a switching procedure until the number of propellant charges has been used up. The plugs prevent more than one propellant charge from being ignited at the same time.

A rod connected to the switching piston and disposed at the side of the second contact sleeve by means of a housing closure is provided advantageously as an engaging device.

In a favorable embodiment, the switching piston has a second isolating section at the side of the second contact sleeve and the second contact sleeve is sealed by a second flange in which is inserted at least one propellant charge generating gas which serves as an engaging device.

There may be a plurality of propellant charges inserted in recesses of the second flange and the recesses of the flange may be sealed with plugs.

The propellant charge may be an explosive propellant charge or a cartridge of a gas under high pressure.

BRIEF DESCRIPTION OF DRAWINGS

Advantageous embodiments of the invention are described in the drawings wherein.

DETAILED DESCRIPTION

Figure 1:
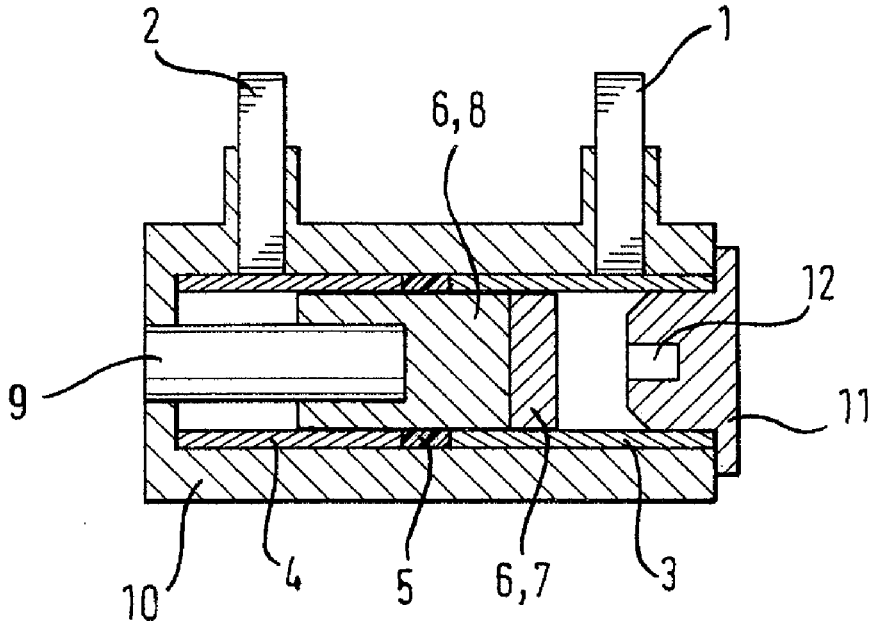
FIG. 1 shows a schematic sectional view of a circuit breaker according to the invention in the closed position and FIG. 2 shows a schematic view of the circuit breaker according to the invention of FIG. 1 in the open position.

FIG. 1 shows a schematic sectional view of a circuit breaker according to the invention in the closed position. A first contact connector 1 and a second contact connector 2 serve as connection for the current lead to be connected which is not illustrated here. First contact connector 1 is joined to a first contact sleeve 3 and second contact connector 2 to a second contact sleeve 4. An insulating sleeve 5 is disposed between first contact sleeve 3 and second contact sleeve 4, isolates these electrically from one another and is aligned in such a manner with first and second contact sleeve 3, 4 that they essentially form a hollow cylinder in which a switching piston 6 is guided. Switching piston 6 has an isolating section 7 and a contact section 8. Connected to switching piston 6 is an engaging rod 9 which is guided out of a housing 10. A flange 11, in which an explosive propellant charge 12 is inserted in a hole, forms an enclosed space with first contact sleeve 3 and isolating section 7 of switching piston 6. In the closed position of the circuit breaker shown here, contact section 8 links first contact sleeve 1 with second contact sleeve 4.

Figure 2:
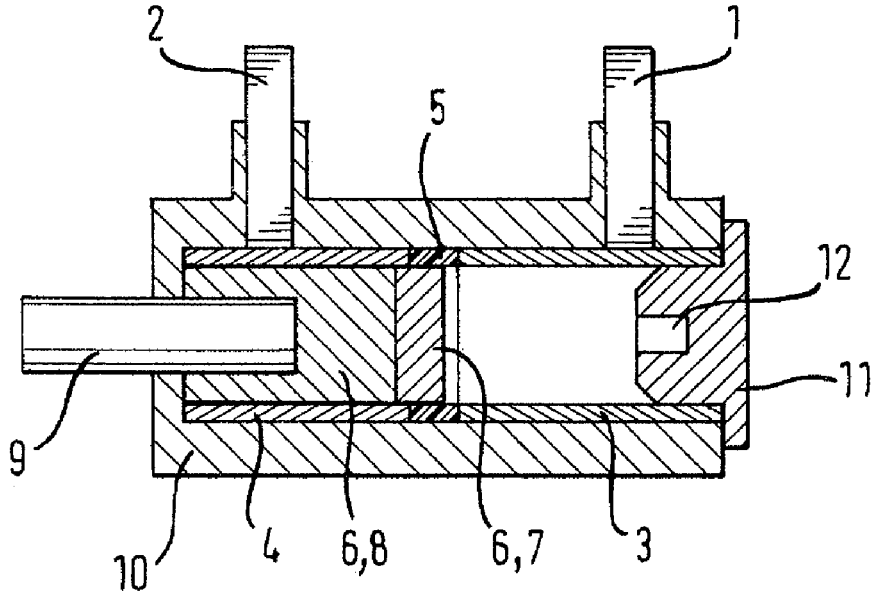

FIG. 2 shows a schematic view of the circuit breaker according to the invention of FIG. 1 in the open position. The same components are provided with the same reference numbers. First contact connector 1 is connected to first contact sleeve 3, second contact connector 2 to second contact sleeve 4 which is isolated from first contact sleeve 3 by insulating sleeve 5. Switching piston 6 with insolating section 7 and contact section 8 has been moved by the gases generated by explosive propellant charge 12 inserted in flange 11 into an open position in which isolating section 7 sits in insulating sleeve 5 and is elastically deformed by said insulating sleeve 5. As a result it exerts a surface pressure on the surface of insulating sleeve 5 and no air gap remains. Engaging rod 9 projects out of housing 10 in the open position.

When the circuit breaker is operated, explosive propellant charge 12 is ignited and the explosion gases press on isolating section 7 and drive switching piston 6 out of the closed position into the open position. When contact section 3 of switching piston 6 detaches itself from first contact sleeve 1, a very rapid interruption of the electrical connection takes place as switching piston 6 has already been accelerated and moves at very high speed. Isolating section 7 has a diameter such that it is elastically deformed on pushing into insulating sleeve 5 and exerts a surface pressure on the inner surface of insulating sleeve 5. This prevents an air gap between insulating sleeve 5 and isolating section 7. An arc is immediately interrupted or its occurrence prevented since contact section 8 only detaches itself from first contact sleeve 3 and interrupts the electrical connection when isolating section 7 immediately adjacent to switching piston 6 is pushed into insulating sleeve 5. Switching piston 6 may be pushed back into its closed position using engaging rod 9. A plurality of explosive propellant charges 12 may be disposed in their own holes respectively which are sealed with plugs. As a result, on ignition of an explosive propellant charge 12, the other charges are not ignited as well and the circuit breaker can be actuated and reset a plurality of times until explosive propellant charges 12 have been used up and are replaced.

Figure 3:
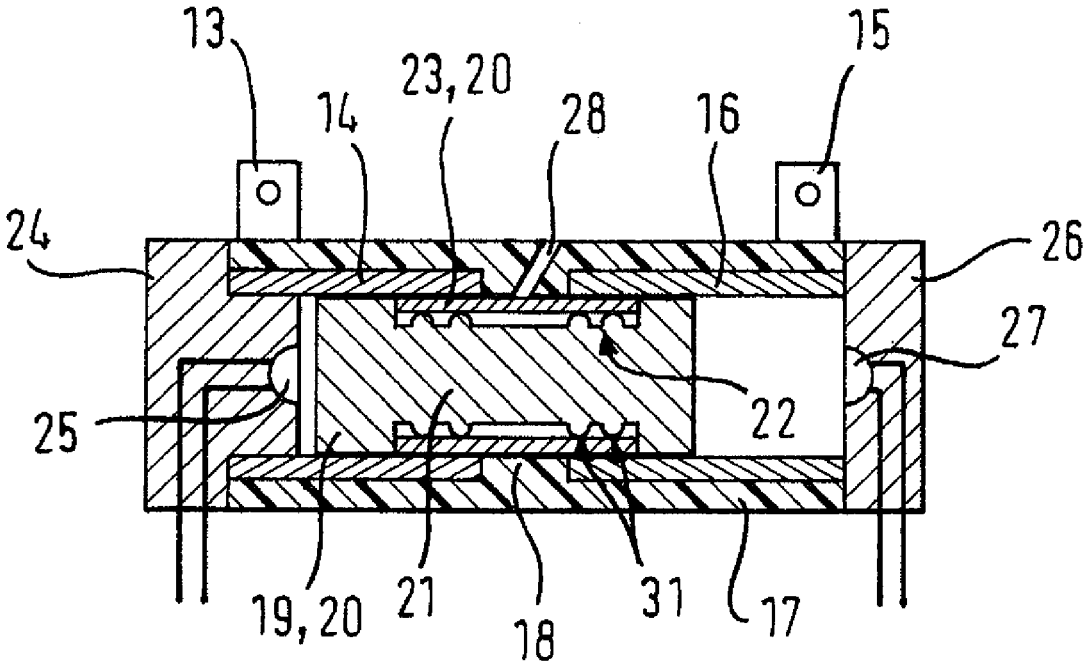
FIG. 3 shows a schematic view of a further embodiment of a circuit breaker according to the invention and FIG. 4 shows a perspective view of an alternative contact section of a switching piston.

FIG. 3 shows a schematic view of a further embodiment of a circuit breaker according to the invention. A first contact connector 13 is connected so as to be electrically conductive to a first contact sleeve 14 and a second contact connector 15 is connected so as to be electrically conductive to a second contact sleeve 16. A housing 17 is formed in one piece with an insulating sleeve 18 which isolates first contact sleeve 14 and second contact sleeve 16 from each other. As a result, it is only necessary to adapt this insulating sleeve 18 if the circuit breaker is to be designed for different voltages. A split piston 21 that has split rings 22 and which is inserted in a metal sleeve 23 is formed onto an isolating section 19 of a switching piston 20, said metal sleeve serving as the contact section of switching piston 20. By means of split rings 22, metal sleeve 23, the thickness of which is chosen so that it can be deformed by the force of the elastic deformation of split piston 20, is flared in the shape of a ring and has a higher surface pressure in these contact areas 31 vis-à-vis first contact sleeve 14 and second contact sleeve 16 respectively. In a closure flange 24 is inserted a plurality of explosive charges 25 which can be ignited by way of electrical connection wires. At the opposite end of the circuit breaker is disposed a second closure flange 26 in which a plurality of propellant charges 27 is inserted. Explosive charges 25 and also propellant charges 27 may be protected against co-actuation on ignition of another charge by means of plugs or cover plates not shown here. In the open position explosion gases may escape through a ventilation hole 28.

By igniting explosive charge 25, the circuit breaker can be actuated as already described above for the first embodiment in FIG. 1 and FIG. 2. A simple and inexpensive metal sleeve 23 may be used as the contact section due to split rings 22. If a propellant charge 27 is ignited in the open position after the gases have escaped through ventilation hole 28, then switching piston 6 is pushed back into the closed position.

Figure 4:
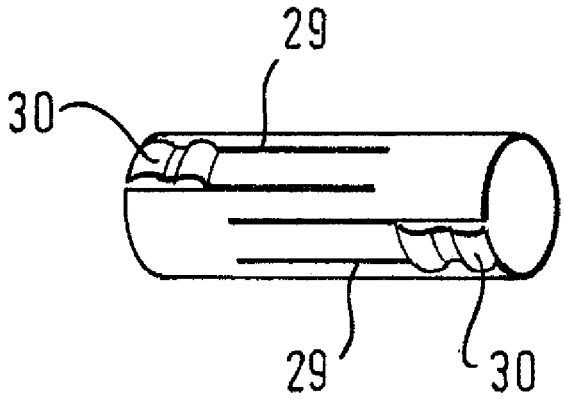

FIG. 4 shows a perspective view of an alternative embodiment of the metal sleeve of FIG. 3. As an alternative to the split rings in FIG. 3, a secure contact with first contact sleeve 14 and second contact sleeve 16 respectively in FIG. 1 is likewise achieved by means of longitudinal slots 29 and convex stampings 30. The material of the metal sleeve must be a spring material for this purpose.

REFERENCE NUMBERS

1 first contact connector
2 second contact connector
3 first contact sleeve
4 second contact sleeve
5 insulating sleeve
6 switching piston
7 isolating section
8 contact section
9 engaging rod
10 housing

11 flange
12 explosive charge
13 first contact connector
14 first contact sleeve
15 second contact connector
16 second contact sleeve
17 housing
18 insulating sleeve
19 isolating section
20 switching piston
21 split piston
22 split ring
23 metal sleeve
24 first closure flange
25 explosive charge
26 second closure flange
27 propellant charge
28 ventilation hole
29 longitudinal slot
30 stamping
31 contact area

The invention claimed is:

1. A circuit breaker comprising:

a first contact sleeve, a second contact sleeve, an insulating sleeve disposed between the first contact sleeve and the second contact sleeve, a switching piston with at least one contact section and an isolating section, which is disposed at a side of the contact section, wherein the switching piston is movable in the first contact sleeve, the second contact sleeve and the insulating sleeve between a closed position in which the contact section of the switching piston connects the first contact sleeve with the second contact sleeve so as to be electrically conductive, and an open position in which the contact section of the switching piston- does not connect the first contact sleeve with the second contact sleeve, wherein the contact section has contact areas that establish an electrically conductive contact with the first contact sleeve and/or the second contact sleeve, wherein the contact section has a metal sleeve into which is inserted a split piston of elastic material with split rings- and that the contact areas are ring-shaped spread out areas of the metal sleeve formed by the split rings, wherein the isolating section is elastically deformable and in the insulating sleeve exerts a surface pressure force on a surface thereof due to elastic deformation, wherein the first contact sleeve is sealed by means of a flange in which is inserted at least one propellant charge that generates gas; and wherein there is a plurality of propellant charges inserted in recesses of the flange and the recesses of the flange are sealed with plugs.

2. The circuit breaker according to claim 1, wherein the split piston is integral with the isolating section.

3. The circuit breaker according to claim 1, wherein at least one contact area on an outermost edge of the contact section and immediately next to the isolating section is disposed to be abutting.

4. The circuit breaker according to claim 1, wherein the insulating sleeve is integral with a housing component of the circuit breaker.

5. The circuit breaker according to claim 1, wherein the propellant charge is an explosive charge or a cartridge of a gas under high pressure.

6. The circuit breaker according to claim 1, wherein the isolating section of the switching piston seals against gases in relation to the first contact sleeve.

7. The circuit breaker according to claim 1, wherein an engaging device is provided with which the switching piston can be moved from the open position into the closed position.

8. The circuit breaker according to claim 7, wherein the switching piston at a side of the second contact sleeve has a second isolating section and the second contact sleeve is sealed by a second flange in which is inserted at least one propellant charge generating gas, which serves as the engaging device.

9. The circuit breaker according to claim 8, wherein there is a plurality of propellant charges inserted in recesses of the second flange, the recesses of the flange being sealed with plugs.

10. The circuit breaker according to claim 8, wherein the propellant charge is an explosive charge or a cartridge of a gas under high pressure.

* * * * *